US006541708B2

(12) United States Patent
Suehiro

(10) Patent No.: US 6,541,708 B2
(45) Date of Patent: Apr. 1, 2003

(54) HELICAL SURFACED CONDUCTOR AND HELICAL SURFACED CONDUCTOR DEVICE PROVIDED THEREWITH

(75) Inventor: Jyunrou Suehiro, Fukui-ken (JP)

(73) Assignee: Apollo Science Laboratory Co., Ltd., Fukui-Ken (JP)

( * ) Notice: Subject to any disclaimer, the term of this patent is extended or adjusted under 35 U.S.C. 154(b) by 0 days.

(21) Appl. No.: 09/887,169

(22) Filed: Jun. 25, 2001

(65) Prior Publication Data

US 2002/0050392 A1 May 2, 2002

(30) Foreign Application Priority Data

Jun. 23, 2000 (JP) ..... 2000-190314

(51) Int. Cl.[7] ..... H01B 13/10

(52) U.S. Cl. ..... 174/126.3; 174/129 R; 174/106 R

(58) Field of Search ..... 174/126.3, 129 R, 174/133 R, 106 R, 108, 102 D

(56) References Cited

U.S. PATENT DOCUMENTS 8,429 A * 10/1851 Vermilya et al. ..... 415/188
186,503 A * 1/1877 Snook ..... 174/133 R
284,423 A * 9/1883 Hollingshead ..... 174/106 R
290,769 A * 12/1883 Gray ..... 174/133 R
543,960 A * 8/1895 Gray ..... 174/133 R
2,060,859 A * 11/1936 Flynt
4,280,016 A * 7/1981 Ege ..... 174/102 R
4,376,920 A * 3/1983 Smith ..... 174/105 R
4,883,922 A * 11/1989 Yokota et al. ..... 174/125.1
5,181,316 A * 1/1993 Pote et al. ..... 156/54

* cited by examiner

*Primary Examiner*—Chau N. Nguyen
(74) *Attorney, Agent, or Firm*—Sughrue Mion, PLLC

(57) ABSTRACT

The object of the present invention is to provide a helical surfaced conductor capable of effectively eliminating noise components while alternating current is turned on and capable of generating a stable magnetic field. To this end, the helical surface conductor has helical grooves or helical protrusions formed on the surface of the conductor. By energizing the helical surfaced conductor according to the present invention, noise components produced while alternating current is turned on can be effectively eliminated. And as a result, it has become possible to generate stable magnetic fields.

6 Claims, 8 Drawing Sheets

HELICAL SURFACED CONDUCTOR AND HELICAL SURFACED CONDUCTOR DEVICE PROVIDED THEREWITH

BACKGROUND OF THE INVENTION

1. Field of the Invention

This invention relates to a conductor capable of producing an alternating current waveform with a minimum level of noises, and in particular to a conductor capable of generating a magnetic field with a minimum level of noises.

2. Description of Related Art

It has been known that the magnetic field produces favorable effects in a sense to the human body.

Therefore, since the energization of a conductor creates a magnetic field, medical instruments based on this principle have been developed.

For example, the application of plasters containing a small magnet on the human skin is known to be an effective way to remove stiff muscles.

In addition, medical instruments that effectively enhances the blood circulation by placing the human body in a magnetic field are known. (Incidentally, the demonstration of such effect is considered to be related with, for example, the influence of iron contained in the human blood.)

In particular, medical instruments based on the use of the alternating current waveform which allows unrestricted control of the output of the magnetic field by controlling the amount of electric current passing therein are now used.

In the meanwhile, commercial AC lines wired indoors, coupled for example with the noise components emitted by indoor or outdoor electric appliances, generate noises in the AC waveform.

For example, noises in the voice messages or picture images delivered by radio or TV receivers are examples of such noises.

Thus, the generation of noises in the AC waveform is unavoidable.

Therefore, the use of medical instruments does not necessarily produce a stable magnetic field constituting a factor for attenuating their effect.

SUMMARY OF THE INVENTION

It is therefore the object of the present invention to solve the problems related with the prior art and to provide a helical surfaced conductor enabling to eliminate effectively noise components while alternating current is turned on and to create a stable magnetic field.

The inventors of the present invention, as a result of their intensive research work for solving said problems, found to their great surprise that the creation of a helical groove on a helical surfaced conductor enables to clearly eliminate noises, and this finding led to the completion of the present invention.

In one respect, the present invention relates to (1) a helical surfaced conductor wherein a helical groove or a helical protrusion is formed on the surface of the conductor.

And in another respect, the present invention relates to (2) a helical surfaced conductor wherein two helical grooves or helical protrusions are formed in mutually opposite directions.

And in still another respect, the present invention relates to (3) a helical surfaced conductor wherein said helical grooves or helical protrusions are formed with the golden angle.

And in still another respect, the present invention relates to (4) a helical surfaced conductor wherein an electric load is connected to one end of the helical surfaced conductor.

And in still another respect, the present invention relates to (5) a helical surfaced conductor device including a first conductor on the surface of which a helical groove or a helical protrusion is formed, a second conductor disposed in the form of a coil on the outside of this first conductor, a cylindrical metal sheet disposed on the outside of said second conductor, and a sheathing disposed on the outside of said cylindrical metal sheet.

And in still another respect, the present invention relates to (6) a helical surfaced conductor device wherein a helical groove or a helical protrusion is formed on the surface of the second conductor.

And in still another respect, the present invention relates to (7) a helical surfaced conductor device wherein the helical grooves or helical protrusions are formed with the golden angle on one or both of said first conductor or second conductor.

And in still another respect, the present invention relates to (8) a helical surfaced conductor wherein an electric load is connected to one end of said helical surfaced conductor device.

In the present invention thus configured, noise components can be effectively eliminated while alternating current is turned on.

As a result, a stable magnetic field can be generated.

DESCRIPTION OF THE PREFERRED EMBODIMENTS

The following is an example of a conductor capable of effectively eliminating noise components while alternating current is turned on.

A helical surfaced conductor according to the present invention and preferred embodiments of devices including the same will be described in details with reference to drawings.

Figure 1:
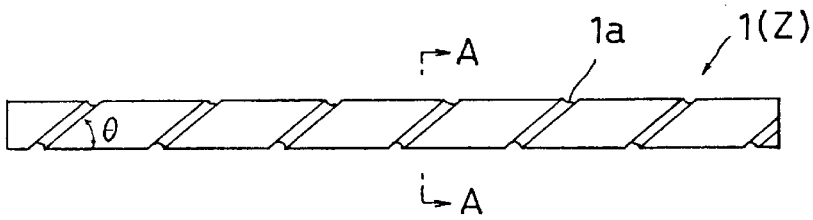
FIGS. 1(A) and 1(B) is a side view and cross sectional view showing the construction of the first preferred embodiment of the helical surfaced conductor according to the resent invention.
Figure 1:
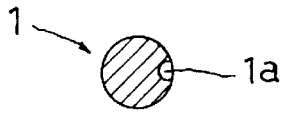

FIG. 1 is an illustration showing the first embodiment of helical surfaced conductor according to the present invention.

(a) is a side view while (b) is a cross section A—A of the conductor shown in FIG. 1(*a*).

As clearly shown in the illustration, the conductor 1 has a circular section and is a long piece having a certain fixed length.

And on its surface a helical groove la in the Z twist direction (in the so-called clockwise direction) is formed.

The angle θ of the groove(the so-called "lead angle") can be set freely.

Figure 2:
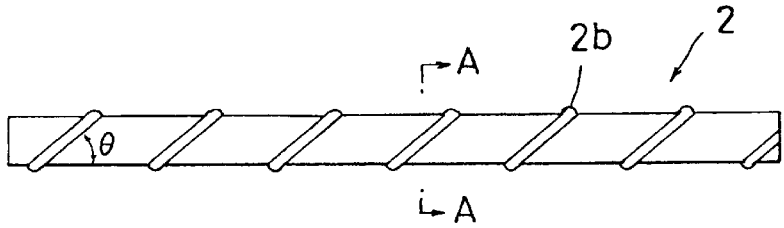
FIGS. 2(A) and 2(B) is a side view and a cross sectional view showing the construction of the second preferred embodiment of the helical surfaced conductor according to the present invention.
Figure 2:
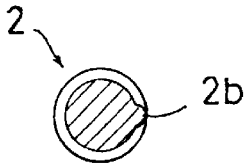

FIG. 2 is an illustration showing the second embodiment of helical surfaced conductor according to the present invention.

(a) is a side view while (b) is a cross section A—A of the conductor shown in FIG. 2(*a*).

As clearly shown in the illustration, the conductor 1 has a circular section and a certain fixed length.

And on its surface a helical protrusion 2*b* in the Z twist direction (or clockwise so to speak) is formed.

The angle θ of this protrusion (the so-called "lead angle") can be freely set.

Figure 3:
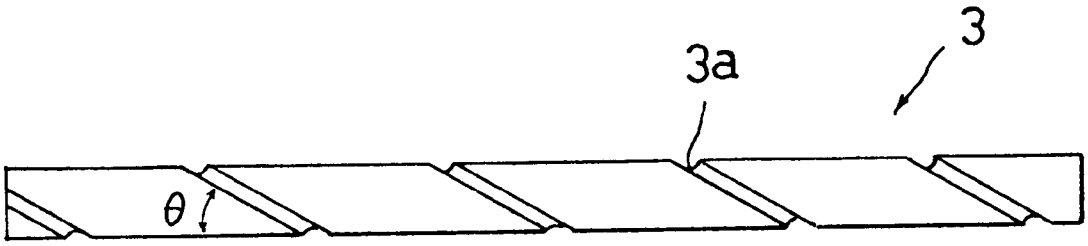
FIG. 3 is an illustration showing the construction of the third preferred embodiment of the helical surfaced conductor according to the present invention.

FIG. 3 is an illustration showing the third embodiment of helical surfaced conductor according to the present invention.

As clearly shown in the illustration, the conductor 1 has a circular section and a certain fixed length.

And on its surface a helical groove 3*a* in the S twist direction (or anticlockwise so to speak) is formed.

The angle θ of this helical groove (the so-called "lead angle") is made sharper than the helical groove la shown in FIG. 1, and the helical groove is in the opposite direction.

Figure 4:
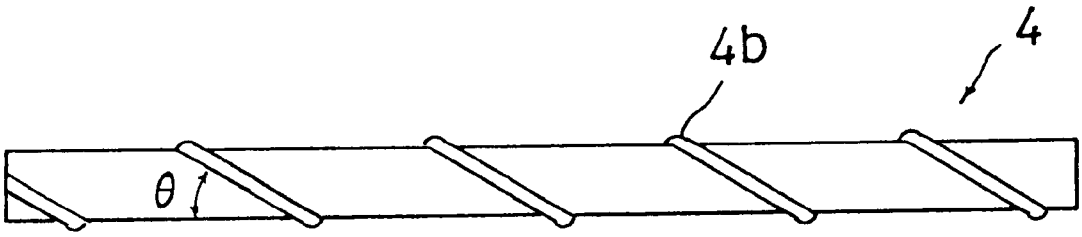
FIG. 4 is an illustration showing the construction of the fourth preferred embodiment of the helical surfaced conductor according to the present invention.

FIG. 4 is an illustration showing the fourth embodiment of helical surfaced conductor according to the present invention.

As clearly shown in the illustration, the conductor 1 has a circular cross section and a certain fixed length.

And on its surface a helical protrusion 4*d* in the S twist direction (or anticlockwise so to speak) is formed.

The angle θ of this helical protrusion (the so-called "lead angle") is made sharper than the helical groove la shown in FIG. 1, and the helical groove is in the opposite direction.

Figure 5:
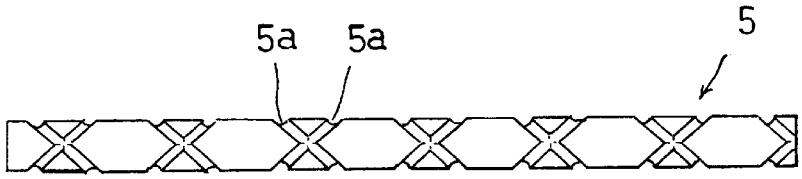
FIGS. 5(A) to 5(D) is an illustration showing the construction of the fifth preferred embodiment of the helical surfaced conductor according to the present invention.
Figure 5:
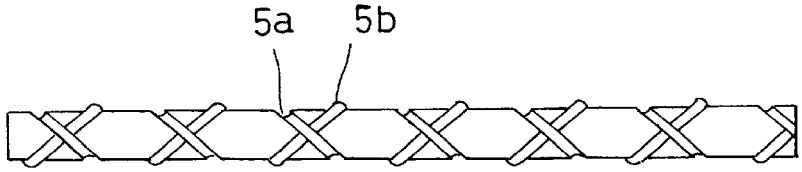
Figure 5:
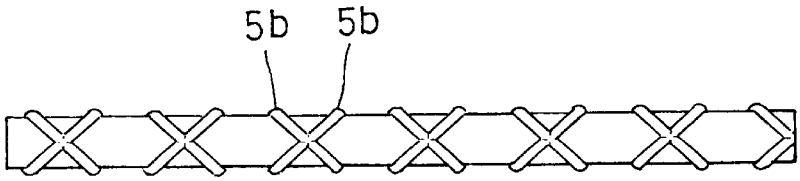
Figure 5:
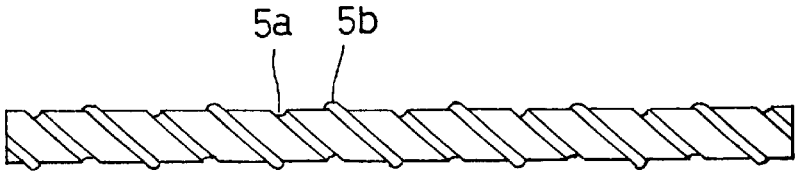

FIG. 5 is an illustration showing the fifth embodiment of helical surfaced conductor according to the present invention.

In this embodiment, two helical grooves 5*a* (protrusions 5*b*) mutually in opposite direction are formed.

(a) is an example wherein two grooves, a helical groove 5*a* in the S twist direction and a helical groove 5*a* in the Z twist direction are formed, (b) is an example wherein a helical groove 5*a* in the S twist direction and a helical protrusion 5*b* in the Z twist direction are formed, (c) is an example wherein two protrusions, a helical protrusion 5*b* in the S twist direction and a helical protrusion 5*b* in the Z twist direction are formed, and (d) is an example wherein a helical groove 5*a* in the S twist direction and a helical protrusion equally in the S twist direction.

In these (a) through (d), the angle of two helical grooves or protrusions (so-called "lead angle") may be identical or different.

And in (a) through (c), only either one or both of helical grooves in the S twist direction and helical grooves in the Z twist direction may be plural.

Furthermore in (d), only either one or both of helical grooves in the S twist direction and helical protrusions in the S direction may be plural.

It is needless to say that helical surfaced conductors 1 through 5 shown in FIGS. 1 through 5 may be of different diameters and lengths.

And the cross section may be of other forms such as elliptic or angular.

And the cross section of helical grooves or protrusions may be semicircular, a form obtained by removing a part of circle, or angular and many other options are available.

As for the material of the helical surfaced conductor 1, a large variety may be chosen provided that they are in principle conductive. For example, metals such as copper, iron and carbon maybe chosen.

The helical surfaced conductors described above are designed in such a way that their use would lead to an ideal waveform from which the noise components of AC waveform are removed.

For this reason, their integration into other apparatuses (electrically loaded) such as medical instruments will produce similar effects.

And now, the inventors will explain on the angle of the helical grooves 1*a* and 3*a* or helical protrusions 2*a* and 3*a*.

Figure 6:
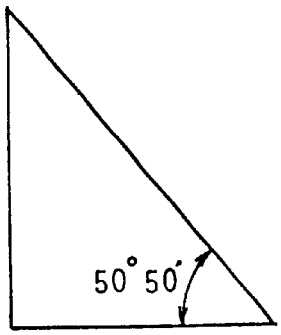
FIGS. 6(A) and 6(B) is an illustration designed to explain the angle of helical grooves in the preferred embodiment of the present invention.
Figure 6:
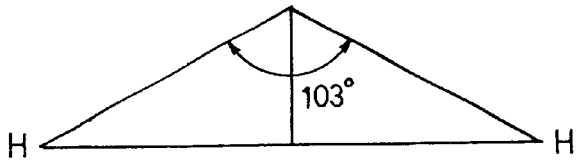

FIG. 6 is an illustration designed to explain the angle θ of helical grooves or helical protrusions (so-called "lead angle").

This angle may be freely set. Yet, in particular the so-called golden angle or about 50 degrees 50 minutes (50° 50) is preferable.

Incidentally, the golden angle is known by experience to be a very important value as the optimum value for determining the beauty of architectures, paintings and sculptures and also as the optima value for the growth of fauna and flora in the nature (energy phenomenon of repeating growth and contraction).

For reference, the example of the Pyramids (FIG. 6(*a*)) and that of the molecular structure of water (FIG. 6(*b*)) are shown.

Figure 7:
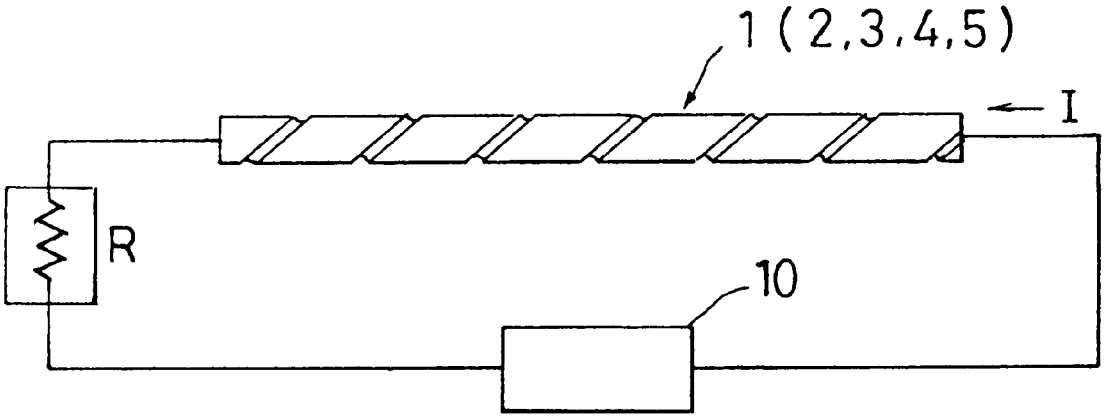
FIG. 7 is a circuit diagram designed to illustrate the condition for the generation of magnetic fields in the preferred embodiments of the present invention.

Then, FIG. 7 is an example of circuit of a magnetic field generator using the helical surfaced conductors according to the present invention.

The connection of the conductors shown in FIGS. 1 through 5 to a power supply 10 and a load R leads to the generation of a magnetic field.

The AC waveform generated here is free of noises, and therefore the magnetic field generated is stable and efficient.

Figure 8:
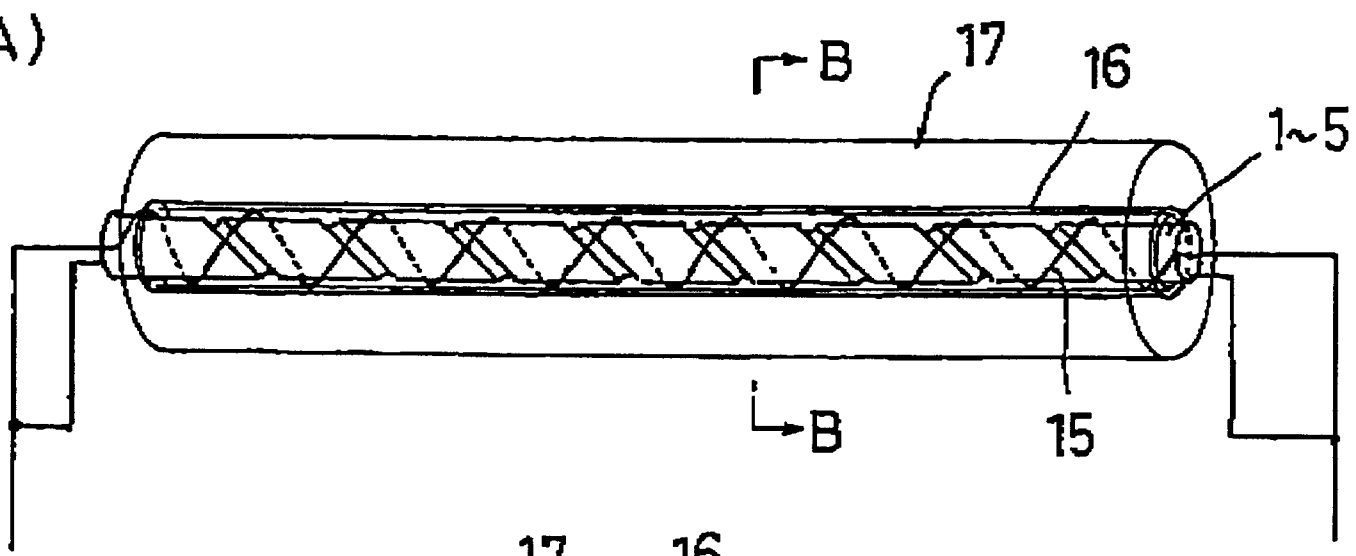
FIGS. 8(A) and 8(B) is an perspective view showing the device including the helical surfaced conductors shown in said FIGS. 1 to 5.
Figure 8:
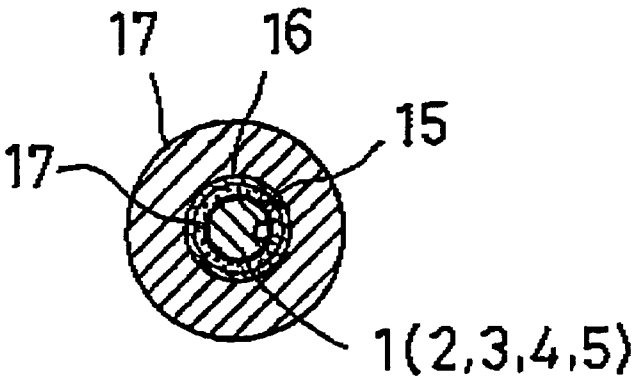

FIG. 8 is a view showing a device including the helical surfaced conductors shown in said FIGS. 1 through 5.

(a) is a perspective view showing schematically a helical surfaced conductor device wherein helical surfaced conductors are used, and (b) is the cross section A—A of the device shown in (a), As the illustration shows, to begin with the first conductor is disposed in the center, For this first conductor, the conductor 1 (2, 3, 4, or 5) shown in each embodiment (FIGS. 1 through 5) may be used.

Here, a helical surfaced conductor device wherein the first conductor is surfaced with a helical groove in the S twist direction is shown.

On the outside of this first conductor, another second conductor 15 is disposed.

For this second conductor, a conductor with a diameter smaller than the first conductor or a coil wire is used, and regarding the helical twist direction of this coil wire, the Z twist direction is used.

Both ends of the second conductor are electrically connected with both ends of the first conductor.

And it is preferable to form helical grooves or protrusions as shown in the helical surfaced conductors 1 through 5 shown in FIGS. 1 through 5 also on the second conductor 15.

On the outside of this second conductor a cylindrical metal sheet 16 is disposed.

This cylindrical metal sheet 16 covers the outer periphery of the second conductor 15, and a special metal sheet, for example an amorphous metal sheet is used as its material.

And the external side of this special metal sheet is covered with a sheathing 17.

As the material for this sheathing 17, a synthetic resin for example is used. It specific terms, the use of polyurethane, acrylic resin, and inorganic powders (pulverized tourmaline, serpentine, etc.) is preferable.

In this connection it is noted that it is more desirable to fill the same material as the sheathing 17 between the cylindrical metal sheet 16 and the first conductor.

This sheathing forms a specific shape for the external form, in this case cylinder.

And the grooves of the first conductor may be in the Z twist direction, and the coil wire constituting the second conductor may be S twisted.

And when the coil-shaped wire is surfaced with helical grooves, their direction may be S or Z twisted.

When a voltage (AC) is applied to both ends of said helical surfaced conductor device, the AC waveform on its output side will be freed from noise components, and as a result a magnetic field will be generated by a voltage free from noise components.

This is natural because the first conductor or the second conductor has such a function.

[Actual Measurement 1]

Then an experiment was conducted in order to show the effect of the conductor 1 surfaced with helical grooves.

The result was compared with the performance of a helical surfaced conductor without any helical groove or protrusion.

Figure 9:
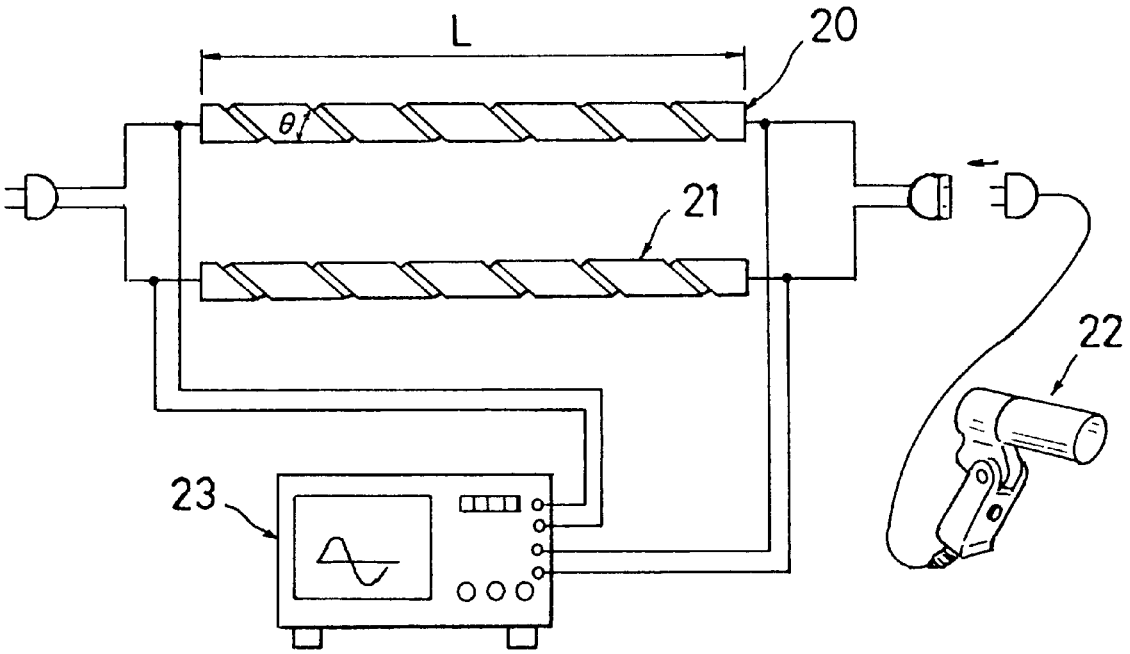
FIG. 9 is an illustration designed to illustrate the experiment to eliminate and observe noise components in the preferred embodiments of the present invention.

FIG. 9 is an illustration made to explain an observation experiment on removing noise components.

To begin with, a helical surfaced conductor (made of copper) with a helical groove in the Z twist direction (the section of the helical groove is semicircular) as shown in the first embodiment of the present invention was prepared ready for the experiment.

The helical surfaced conductor 20 is 250 mm long and its diameter is 6 mm,

And four test pieces with an angle θ of helical groove 80°, 53° and 20° and without any groove (respectively test piece 1, test piece 2, test piece 3, and test piece 4) were made ready for the test.

On one end of the helical surfaced conductor 20 commercial AC (100V) was inputted, and on the output side thereof a dryer 22 was connected as a load.

The specifications of the dryer 22 are: made by IZUMI, rated values of 100V, 1,200 W and 50–60 Hz.

Both ends of the helical surfaced conductor 20, with AC input on one end and AC output on the other end, were connected with a dual trace oscilloscope (SS-5702 DC-20M1 Hz as the standard) to observe the waveform.

As a result, in the case of helical surfaced conductors according to the present invention, the noise components of the AC waveform are effectively eliminated.

Figure 10:
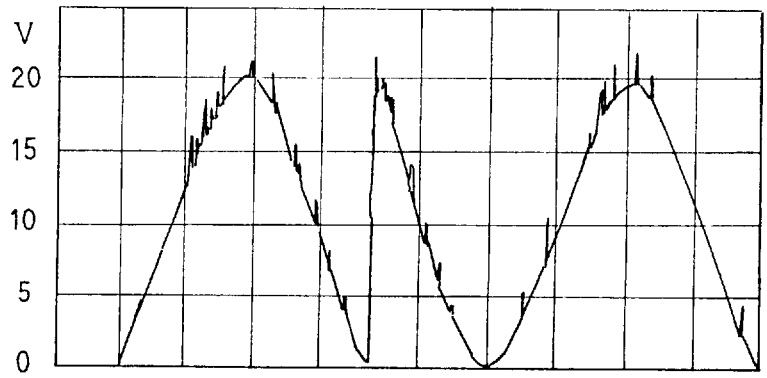
FIGS. 10(A) and 10(B) is a diagram designed to illustrate the waveform examples resulting from actual measurements in the preferred embodiments of the present invention.
Figure 10:
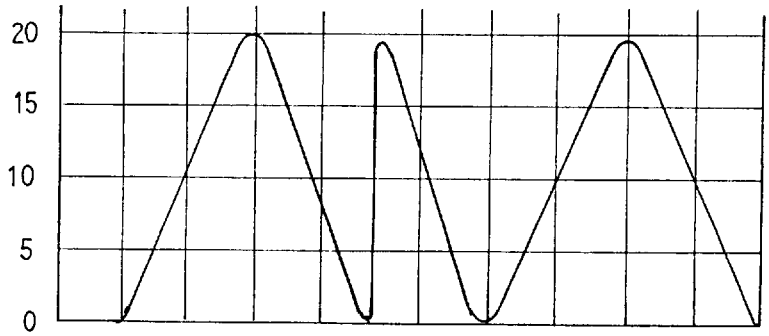

FIG. 10 shows an example of AC waveform actually measured (incidentally, the waveform shown here is the typical average of actual measurements given for the sake of convenience.)

And FIG. 10(A) shows the waveform of AC inputs when the angle θ of the helical groove is 53° (test piece 2).

FIG. 10(B) shows the waveform of AC outputs when the angle θ of the helical groove is 53° (test piece 2).

In comparison with the former waveform, the latter waveform shows the effective elimination of noise components.

In the case of test piece 4, however, both the input and output take the form of AC waveform as shown in FIG. 10(A).

[Actual Measurement 2]

Then, in place of the conductors used in said experiment 1, helical surfaced conductors provided with helical protrusions (the groove angle θ being 80°, 53°, 20° and without any groove) are used to conduct similar experiments.

As a result, in the case of helical surfaced conductors according to the present invention (other than those without grooves), the noise components of AC waveform are effectively eliminated.

[Actual Measurement 3]

And, in place of the conductors used in said experiment 1, experiments were conducted by the same conditions as said experiment 1 except that the cross section of the conductors was square.

[Actual Measurement 4]

And, in place of the conductors used in said experiment 1, experiments were conducted by the same conditions as said experiment 1 except that conductors wherein both a helical groove in the S twist direction and a helical groove in the Z twist direction are formed (corresponding to FIG. 5(A)) are used.

As described above, experiment 2, experiment 3 and experiment 4 showed that the helical surfaced conductors according to the present invention are effectively free of noise components in AC waveform.

[Actual Measurement 5]

Further experiments were conducted by using a helical surfaced conductor device shown in FIG. 8.

The helical surfaced conductor device used in the experiments includes the first conductor (250 mm long and 6 mm in diameter) the helical groove of which inclines in the S twist direction (θ=53°), and the second conductor consisting of a coil wire (1 mm in diameter) is wound in the Z twist direction and has no groove.

The cylindrical metal sheet is made of an amorphous metal sheet, and the sheathing is made of polyurethane resin.

On one of the helical surfaced conductor device commercial AC (100V) is inputted, and on the output side a dryer similar to the one used in the experiment 1 is connected as a load.

Both ends of the helical surfaced conductor 20, with AC input on one end and AC output on the other end, were connected with a dual trace oscilloscope (SS-5702 DC-20M1 Hz as the standard) to observe the waveform.

As a result, the noise components of the AC waveform are effectively eliminated.

The foregoing is a description of the present invention. It is needless to say, however, that the present invention allows a number of variations as long as they are consistent with the essence of the present invention.

As is evident from the description given above, the use of the helical surfaced conductors according to the present invention can effectively eliminate the noise components while AC is turned on.

As a result, it has become possible to generate stable magnetic fields.

What is claimed is:

1. A helical surfaced conductor device comprising:

a first conductor wherein a helical groove is formed on the surface of the first conductor;

a second conductor disposed in the form of a coil on the outside of said first conductor in a state not to be engaged in the helical groove;

a cylindrical metal sheet disposed on the outside of said second conductor; and a sheathing disposed on the outside of said cylindrical metal sheet, wherein the helical groove is also formed on the surface of the second conductor.

2. The helical surfaced conductor device according to claim 1, wherein the helical groove of one of or both the first conductor or the second conductor are formed with the angle of 50° 50' (50 degrees 50 minutes).

3. The helical surfaced conductor device according to claim 1, wherein one end of said helical surfaced conductor device is connected with an electric load.

4. A helical surfaced conductor device comprising:

a first conductor wherein a helical groove is formed on the surface of the first conductor;

a second conductor disposed in the form of a coil on the outside of said first conductor in a state not to be engaged in the helical groove;

a cylindrical metal sheet disposed on the outside of said second conductor; and a sheathing disposed on the outside of said cylindrical metal sheet, wherein a material which is the same as the sheathing is filled between the cylindrical metal sheet and the first conductor.

5. The helical surfaced conductor device according to claim 4, wherein the helical groove of the first conductor is formed with the angle of 50° 50' (50 degrees 50 minutes).

6. The helical surfaced conductor device according to claim 4, wherein one end of said helical surfaced conductor device is connected with an electric load.

* * * * *